US008579782B2

(12) United States Patent
Ponti

(10) Patent No.: US 8,579,782 B2
(45) Date of Patent: Nov. 12, 2013

(54) METHOD FOR APPLICATION OF A FILM AT AN ENVELOPE WINDOW MADE OF A SHEET OR A PORTION OF SHEET

(75) Inventor: Francesco Ponti, Cerbara-Citta'di Castello (IT)

(73) Assignee: C.M.C. S.r.l., Cerbara-citta di Castello (Perugia) (IT)

( * ) Notice: Subject to any disclaimer, the term of this patent is extended or adjusted under 35 U.S.C. 154(b) by 0 days.

(21) Appl. No.: 13/502,688

(22) PCT Filed: Oct. 19, 2010

(86) PCT No.: PCT/IB2010/054729
§ 371 (c)(1),
(2), (4) Date: Apr. 18, 2012

(87) PCT Pub. No.: WO2011/048545
PCT Pub. Date: Apr. 28, 2011

(65) Prior Publication Data

US 2012/0214656 A1 Aug. 23, 2012

(30) Foreign Application Priority Data

Oct. 20, 2009 (IT) ..... B02009A0677

(51) Int. Cl.
*B31B 1/00* (2006.01)
*B31B 1/82* (2006.01)

(52) U.S. Cl.
USPC ..... 493/222; 156/108; 156/230; 493/919

(58) Field of Classification Search
USPC ..... 156/108, 230, 231, 238; 493/919, 186, 493/222; 83/911
See application file for complete search history.

(56) References Cited

U.S. PATENT DOCUMENTS

| | | | | |
|---|---|---|---|---|
| 1,958,005 | A | 5/1934 | Klinger | |
| 4,447,481 | A | 5/1984 | Holmberg et al. | |
| 2008/0103035 | A1 * | 5/2008 | Kristel | 493/480 |

OTHER PUBLICATIONS

International Search Report for PCT/IB2010/054729, Mailed Mar. 17, 2011, 2 pages.

* cited by examiner

*Primary Examiner* — Jeff Aftergut
*Assistant Examiner* — Carson Gross
(74) *Attorney, Agent, or Firm* — William J. Sapone; Ware Fressola Maguire & Barber LLP

(57) ABSTRACT

The method relates to application of a transparent film (3) to a window (2) realized in a portion of paper (1), the portion of paper (1) being defined in a continuous strip (10) destined to be wound in a reel. The film (3) exhibits larger dimensions than the window (2), such that a frame (30) is defined about the window (2), a total thickness of which is given by the portion of paper (1) plus the film (3). The method includes a stage of pressing with which at least a part of the frame (30) is brought to a total thickness which is not greater than an original thickness of the portion of paper (1). This enables the strip (10) to be wound strictly adheringly in the various spires thereof.

3 Claims, 5 Drawing Sheets

METHOD FOR APPLICATION OF A FILM AT AN ENVELOPE WINDOW MADE OF A SHEET OR A PORTION OF SHEET

TECHNICAL FIELD

The invention relates to a method for production of envelopes for automatic envelope-packing machines.

BACKGROUND ART

Machines are known which include the use of windowless envelopes, obtained starting from a strip of paper wound on a reel on a sprocket without containing edges.

The strip of paper includes, in succession, the printed signs for each envelope and the markers for the separation of the signs.

The reel is loaded in a feeder associated to the machine and the band is sent to an envelope-forming station; the envelopes are then transferred to an insertion station where the line carrying the stacks of sheets to be introduced into each envelope leads.

Each envelope, either before or after the introduction of the relative stack, crosses a printing station which prints thereon the address of the addressee, according to a list memorised in a command board associated to the station.

The above-described machines, thanks to the high operating speed and the low costs of the envelopes thus-presented, are preferred for sending non-personalised content, where each addressee receives the same materials, for example advertising, informative and the like.

In this case the only distinctive element between one envelope and a next is the address printed on the envelope; thus it is not necessary to check that one stack of material is inserted rather than another.

The situation is different when the correspondence is personalised, for example for sending bills, bank current accounts and the like, in which it is necessary for the material to be sent to a particular addressee.

In theory, if the sequence of the prepared stacks matches that of the stored addressees, the correct combination could be achieved, but any problem that might arise would lead to a staggering of the lists, with all the ensuing risks that would bring.

For these types of operations, envelopes bearing at least a transparent window are preferred, as the address on the stack can be seen and read; in this way any errors of combination between the envelope and the contents will be revealed.

Machines are known which use the envelopes with windows already prepared, in which the supplier of the envelopes comprises a store, where the envelopes are arranged in piles, and extracting organs which collect them one at a time from the pile in order to send them to the insertion station.

These machines have a limited autonomy, with respect to the cited ones, due to the small capacity of the envelope store, in order to enable an operator to load the store of the feeder without stopping the machine.

Apart from the constant presence of an operator, it is clear that these envelopes with windows have a considerably higher cost than those obtained from a reel, as they have to be realised in a special paper workshop, inserted in boxes, stored and transported to the place of use.

Consequently costs for despatch for correspondence made using the above-mentioned envelopes with windows will be greater.

At present paper reels for envelopes with windows are not available, due to a series of drawbacks, and also due to the additional thickness of the transparent acetate film and the glue, which creates zones of discontinuity in the thickness.

In order correctly to understand the problem, consider that a normal reel of paper for envelopes without windows has a diameter of about 1200 mm and ensures an autonomy of about 30,000 envelopes.

The thickness of the paper usually used is, for example, 0.11 mm, which becomes 0.15 in the frame surrounding the window, where the paper and the acetate film overlap, with an interposing of glue.

When winding a strip of paper with a window and relative acetate the windows are staggered along the winding circumference but are transversally aligned.

The staggering along the winding circumference almost totally compensates for the increase in thickness of the sides of the transversal frames of the reel, which in each new spire are in a new position, different from that of the previous spire.

The transversal sides, therefore, are mutually intercalated and are cyclically at the centre of the underlying windows, where only the thickness of the acetate film is present; the combination of these two factors limits the increase of the development of the circumference of each spire given the increased thickness of the transversal sides of the frame.

The sides of the frame arranged parallel to the winding direction, being wider than the winding direction and aligned transversally, lead to a formation in the reel of two stripes having a greater thickness with respect to the other zones, due to their progressive superposing.

The winding of the spires is consequently tight only at the stripes, while it is substantially loose in the external sides of the reel.

A reel exhibiting the above-described characteristics must necessarily have a limited diameter, less than half with respect to normal reels, in order to contain the inevitable lateral movements which occur, with an operating autonomy reduced to about 5000 envelopes.

Further, the reel is unstable if rested on the ground and creates difficulties in all the manoeuvres for its movement preceding use thereof.

The lack of lateral compactness of the spires makes the edge of the band vulnerable; they can get damaged, resulting in poor-quality envelopes.

SUMMARY OF INVENTION

The aim of the present invention is to provide a method for application of a film at a window in a sheet of paper, which eliminates the differences of thickness in the superposing zones and thus enables reels to be prepared for envelopes with windows without the above-cited drawbacks.

A further aim of the invention is to provide a method which does not lead to weakening of the material of the envelope.

A still further aim of the invention consists in providing a method which is able to deliver the required results without leaving visible traces on the materials, such that the realised envelopes are indistinguishable from others realised not using the method.

A further aim of the method relates to the desire to provide a method which can be realised very economically.

BRIEF DESCRIPTION OF THE DRAWINGS

There follows a description of a preferred embodiment of the method of the invention and some possible variants, in agreement with what is set out in the claims and with the aid of the figures of the drawings, in which:

DESCRIPTION OF THE PREFERRED EMBODIMENTS OF THE INVENTION

Figure 1:
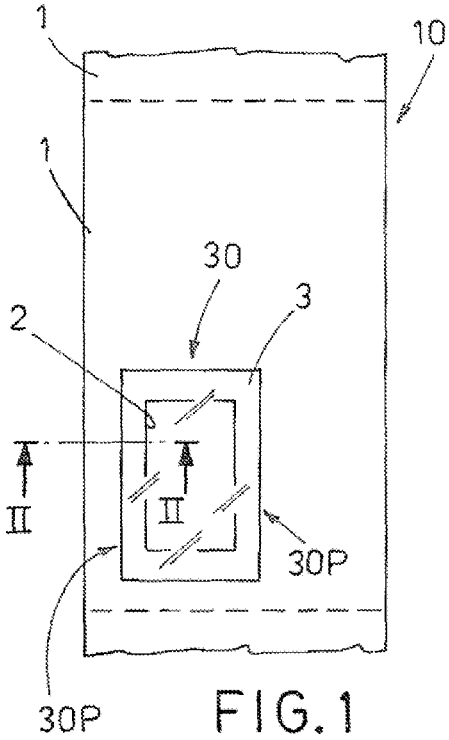
FIG. 1 PRIOR ART
FIG. 1 is a schematic illustration in plan view of a sheet of paper with a window and a buffer film, applied according to the known art.
Figure 2:
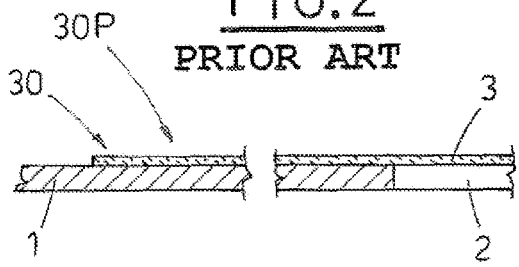
FIG. 2 PRIOR ART
FIG. 2 is a section, in enlarged scale, of a partial section obtained according to plane II-II of FIG. 1.

With the aim of facilitating comparison between the prior art and the results obtainable with the method of the present invention, figures from 1 to 3 illustrate a continuous strip of paper 10, in which portions 1 destined to define an envelope with a window 2 are arranged in succession.

The strip 10, which comes from a feed reel (not illustrated) is unwound in order to enable application of a film of transport acetate 3 for plugging each window 2.

The size of the film 3 is greater than that of the window 2, such that about the window, on the internal side with respective to the envelope to be realised, a frame 30 is defined where the paper of the strip 10 and the acetate film 3 overlap, with an interposing of an appropriate glue.

After application the strip 10 is re-wound onto another reel (also not illustrated).

Figure 3:
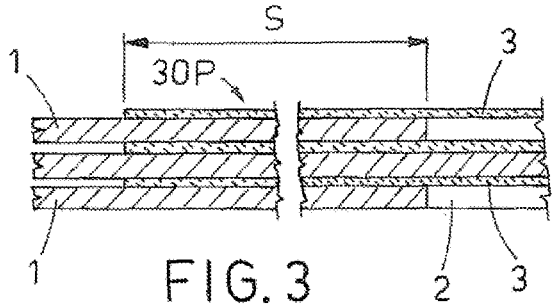
FIG. 3 PRIOR ART
FIG. 3, in the same scale as FIG. 2, is a section in which several sheets as in FIG. 1 are superposed.

FIG. 3 illustrates how the supplementary thickness given by the acetate film 3 leads, at the sides 30P of the frame 30 parallel to the development of the strip 10, to the formation of relative strips S (of which one only is visible) with a greater thickness with respect to the other zones, such as mentioned herein above.

Due to this, when forming the receiving reel, the strip 10 of one spire cannot adhere to the preceding spire, leaving between them a free space which leads to the above-mentioned drawbacks.

The method now described is especially appropriate for optimally preparing reels 100 on which a continuous paper strip 10 is wound, constituted by a succession of predefined portions 1, each of which is destined to conform, thereafter, an envelope with a window 2.

Figure 4:
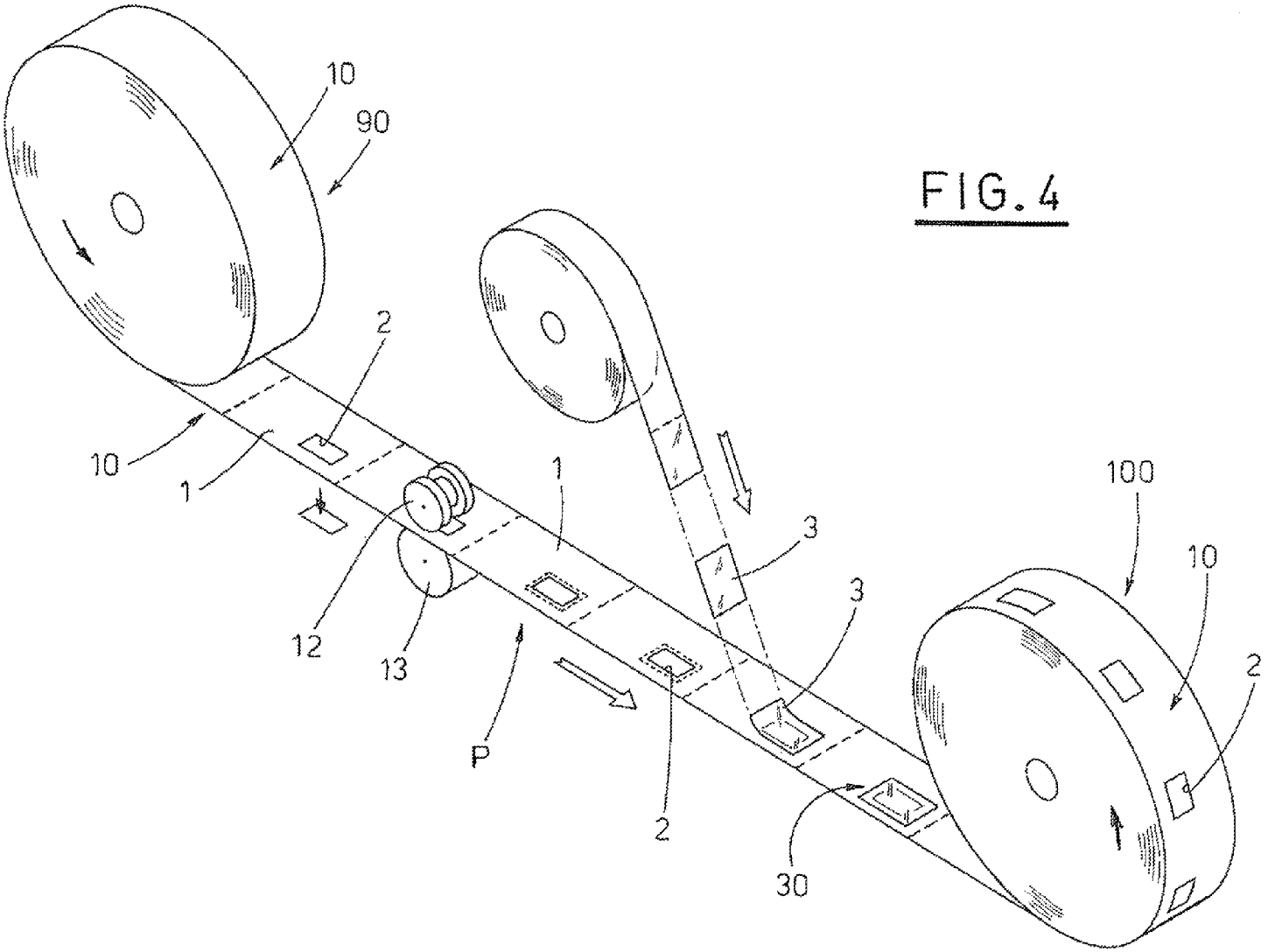
FIG. 4 illustrates, in schematic perspective view, the stages of the method realised on paper in a reel.

With reference to the above-mentioned condition, FIG. 4 schematically illustrates a possible work cycle in which the strip 10 of paper without windows 2 is unwound from a feed reel 90, drawn along a predetermined path P and, thereafter, is rewound onto a receiving reel 100.

In path P the paper strip is subjected to crush forming for the realising of the windows 2, to which relative acetate film 3 is then applied using the method of the invention, with a definition in each envelope 2 of a frame 30.

The method of the invention, should it be required, can be actuated on single portions of paper 1 too, which have been separated from the strip 10, or on like sheets arranged in any way.

The method of the invention comprises a stage of pressing with which at least a part of the frame 30 is crushed such that the total thickness, given the thickness of the sheet or portion of paper 1 plus that of the film 3, is not greater than the original thickness of the sheet or portion of paper 1.

The pressing is performed by known means, for example a pair of counter-rotating rollers 12, 13 (see FIG. 4) or the like, one roller 12 having a central body and disks of greater diameter than the central body located at each end thereof.

In the case of paper in a reel, as illustrated in FIG. 4, the actuating of the method comprises, in a first order, the following succession of steps:

localised pressing of the paper;

application of the glue;

positioning and fixing the film 3.

In this case, the pressing action is only made on the sheet or portion of paper 1, which is subjected, in the zone thereafter occupied by the frame 30, to a reduction of thickness which is at least the same as the thickness of the acetate film 3; the following application of the acetate film does not lead therefore to increases of thickness beyond the original thickness of the sheet or portion of paper 1, or in any case not such as to prejudice the correct winding of the receiving reel 100, as will be better specified herein below.

In a second order, alternative to the first and not illustrated, the following succession of steps occurs:

application of the glue;

positioning and fixing of the film 3;

pressing of at least a part of the frame 30.

In this case the pressing action is done on both the sheet or portion of paper 1 and the acetate film 3, superposed in the frame 30; after the crushing, at least a part of the frame 30 exhibits a total thickness which is not superior to the original thickness of the sheet or portion of paper 1, such as not to compromise correct winding onto the receiving reel, as will be better specified herein after.

Figures from 5 to 10 illustrate a first embodiment of the method, relating for example to paper in reels operating with the above-described first order of succession of stages.

Figure 5:
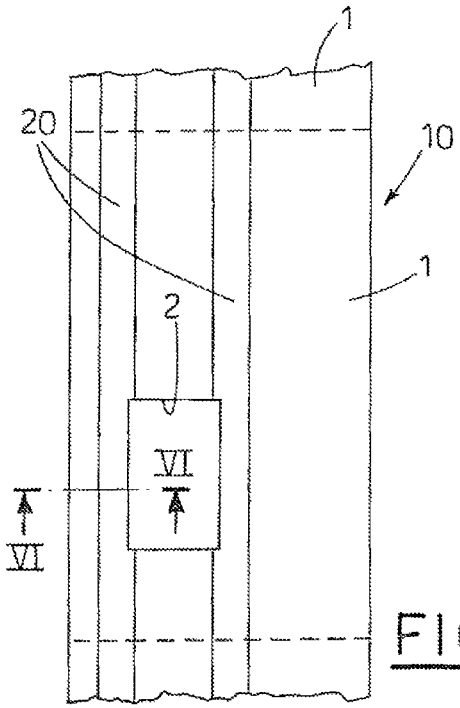
FIG. 5 schematically illustrates, in plan view, a stage of the method in a first embodiment.
Figure 6:
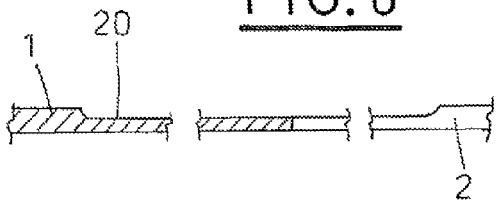
FIG. 6 illustrates, in enlarged scale, a partial section obtained along plane VI-VI of FIG. 5.

The pressing stage, which is done only on the paper, is localised in two parallel stripes 20, arranged by the margin of the opposite sides of the window 2 and extended, continuously, in the advancement direction of the strip 10, from one end to another of the portion 1 and from the portion 1 to the next 1 (FIGS. 5 and 6).

Figure 7:
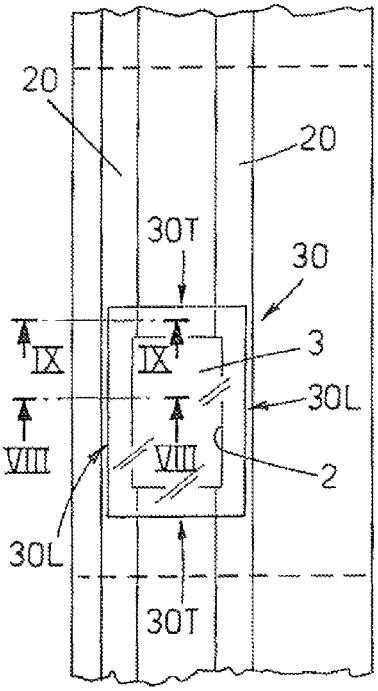
FIG. 7, in a same view as that of FIG. 5, illustrates a successive stage of the method in the first embodiment.

Each stripe 20 exhibits a width which is sufficient to contain the corresponding longitudinal side 30L of the frame 30 following application of the acetate film 3 (FIG. 7).

Figure 8:
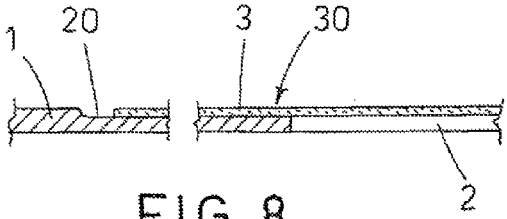
FIG. 8 illustrates, in enlarged scale, a partial section obtained according to plane VIII-VIII of FIG. 7.

FIG. 8 shows how the film 3 remains contained within the original thickness of the paper, even in the internal zone of the two stripes 20, due to the presence of the window 2.

Figure 10:
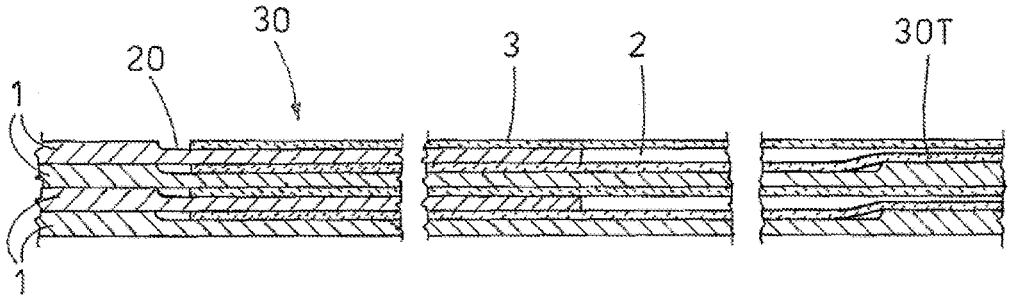
FIG. 10 illustrates a view similar to FIG. 3 for highlighting the results obtained with the method according to the invention.
Figure 9:
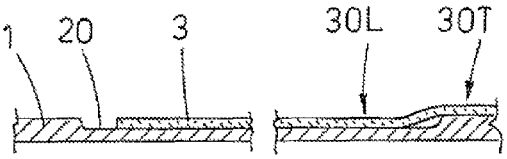
FIG. 9 illustrates, in enlarged scale, a partial section obtained according to plane IX-IX of FIG. 7.

FIG. 9 shows how the transversal sides 30T of the frame 30 exhibit, in the internal zone of the two stripes 20, where the paper is not pressed, a total thickness which is greater than the original thickness of the paper; this condition is not however prejudicial to the purposes of the rewinding of the receiving reel 100, as the transversal sides 30T are mutually intercalated and, cyclically, are arranged in the centre of the underlying windows 2, where there is only the thickness of the acetate film 3 (see in particular FIG. 10).

Figure 11:
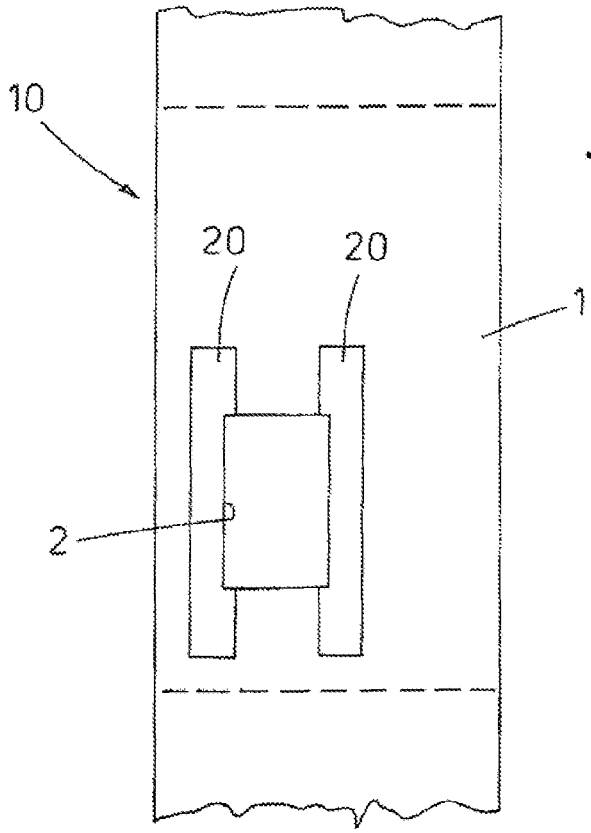
FIGS. 11 and 12 illustrate the same stages of FIGS. 5 and 7, relating to a variant of the first embodiment of the method.
Figure 12:
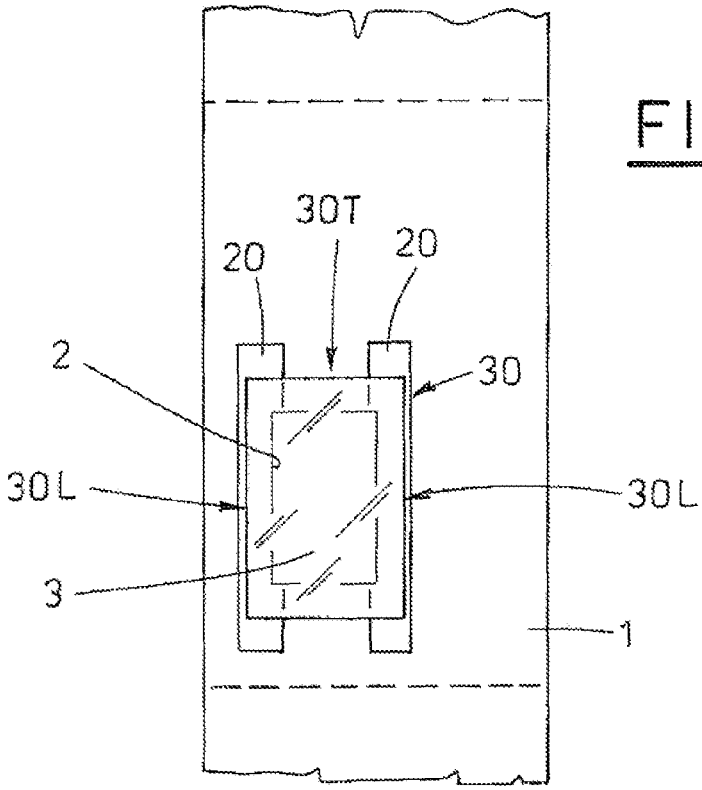

In a variant of the first embodiment of the method illustrated in FIGS. 11 and 12, the stripes 20 develop in length only for a sufficient dimension for passing beyond the dimension of the transversal sides 30T.

The first embodiment of the method and the relative variant described above can be made alternatively operative with the second order of succession of steps (not illustrated as it is obvious).

Figure 13:
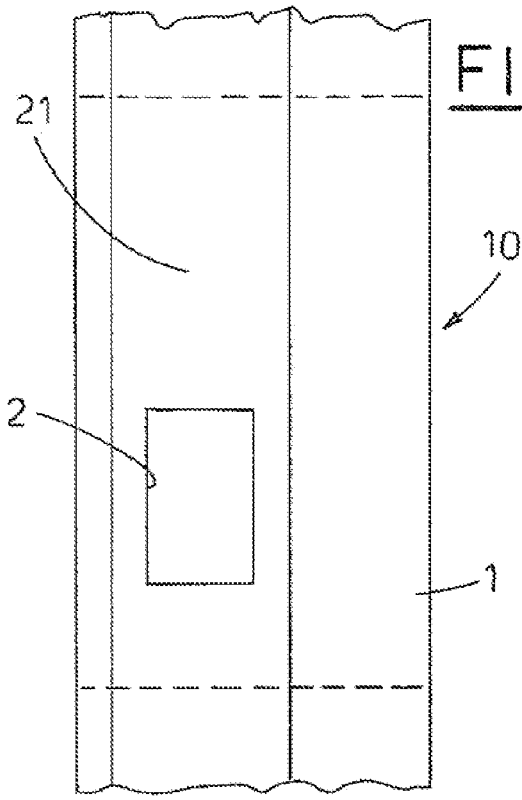
FIGS. 13 and 14 illustrate the same stages as in FIGS. 5 and 7, relating to a second embodiment of the method.
Figure 14:
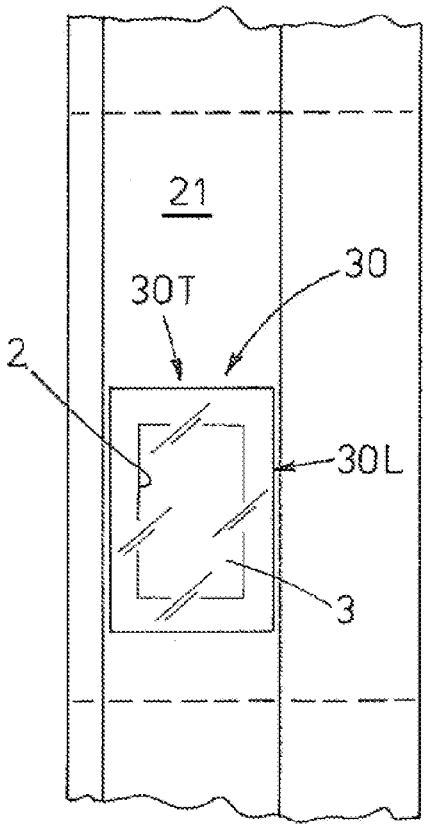

FIGS. 13 and 14 illustrate a second embodiment of the method, relating once more to paper in reels and made operative using the above order of steps.

The pressing step, which involves only the paper, is actuated by means of two parallel stripes mutually flanked, defining a single stripe 21, arranged centred with respect to the window 2, having a width which is greater than that of the frame 30 which will be defined and extended continuously in the advancement direction of the strip 10, from one end to another of the portion 1 and from there to the following portion.

Consequently the transversal sides 30T too of the frame 30 are at the same level as the longitudinal sides 30L.

The second embodiment of the method can be made operative, alternatively, with the second order of succession of the stages (not illustrated as being obvious).

From the above it is clear that the proposed method, even though it is extremely simple, enables all the set aims to be attained, in particular in that it annuls the local difference of thicknesses in the superposing zones between the paper and the acetate film, and enables a correct winding of the spires in a reel, which therefore can have a diameter which is the same as that of the paper reels without windows, and therefore can have a working autonomy which is practically the same as the reels without windows.

Further, problems connected with reel stability are obviated, when rested on the ground, as well as the problems connected with vulnerability of the edges of the strips.

Worthy of note is the fact that the above-mentioned advantages are obtained without weakening the material of the envelope, without leaving visible traces thereon and with practically zero costs.

The foregoing, however, is given by way of non-limiting example any modifications to details thereof in actuation of the invention, apart from those mentioned herein above, are to be considered as falling within the ambit of protection of the present invention defined in the following claims.

The invention claimed is:

1. A method for applying a film around a window positioned in a continuous strip of paper (1), comprising:

applying the film (3) for forming a frame (30) around the window (2), a total thickness of which is a sum of thicknesses of the continuous strip of paper (1) and the film (3), pressing at least the continuous strip of paper (1) at two parallel longitudinal stripes (20), arranged in margins at opposite sides of the window (2), with each of the stripes (20) having a sufficient width for containing a corresponding longitudinal side (30L) of the frame (30), the pressing obtaining, at least at the longitudinal sides (30L) of said frame (30), a total thickness which is not superior to an original thickness of the continuous strip of paper (1), wherein the parallel stripes (20) extend continuously from one end to another end of the continuous strip of paper (1).

2. The method of claim 1 wherein the pressing is performed by a pair of counter-rotating rollers.

3. The method of claim 2 wherein one of the counter-rotating rollers (12) has a central body and disks of greater diameter than the central body located at each end thereof.

* * * * *